US005684882A

United States Patent [19]

Mahieux et al.

[11] Patent Number: 5,684,882

[45] Date of Patent: Nov. 4, 1997

[54] SYSTEM FOR SELECTIVE SOUND CAPTURE FOR REVERBERANT AND NOISY ENVIRONMENT

[75] Inventors: Yannick Mahieux, Tonquedec; Grégoire Le Tourneur, St-Quay-Perros; Alain Saliou, Lannion, all of France

[73] Assignee: France Telecom, Paris, France

[21] Appl. No.: 502,695

[22] Filed: Jul. 14, 1995

[30] Foreign Application Priority Data

Jul. 15, 1994 [FR] France ..... 94 08809

[51] Int. Cl.[6] ..... H04R 3/00

[52] U.S. Cl. ..... 381/92; 381/188; 367/124

[58] Field of Search ..... 381/92, 189, 190, 381/188, 205; 367/124, 119, 121, 126, 129

[56] References Cited

U.S. PATENT DOCUMENTS 4,310,730 1/1982 Aaroe ..... 381/189
4,653,102 3/1987 Hansen .
4,703,506 10/1987 Sakamoto et al. .
4,723,294 2/1988 Taguchi .

FOREIGN PATENT DOCUMENTS 0381498 8/1990 European Pat. Off. .
2559325 8/1985 France .
3330698 3/1984 Germany .

OTHER PUBLICATIONS

A Microphone Array for Multimedia Workstations, by Mahieux et al, 3rd International Workshop on Acoustics Echo Control, 7&* Sep. 1993.

*Primary Examiner*—Curtis Kuntz
*Assistant Examiner*—Vivian Chang
*Attorney, Agent, or Firm*—Larson & Taylor

[57] ABSTRACT

A system for selective sound capture for hands-free telephony and multimedia workstations of the acoustic antenna type with an aerial formed by a member with a concave cylindrical surface. The system includes a plurality of electro-acoustic transducers which are distributed over and in the vicinity of the cylindrical surface. Circuits for partial summation of a plurality of analog sound signals make it possible to form elementary acoustic antennas and a summation circuit produces a resultant analog signal representative of the sound signal arising from a useful speaking area.

9 Claims, 7 Drawing Sheets

Figure 1B:
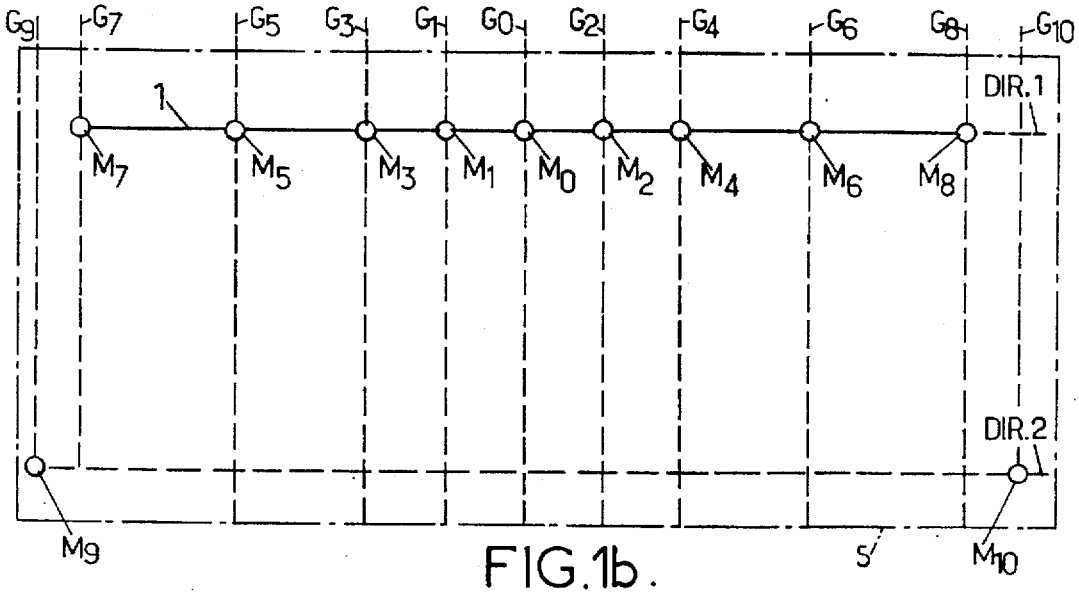

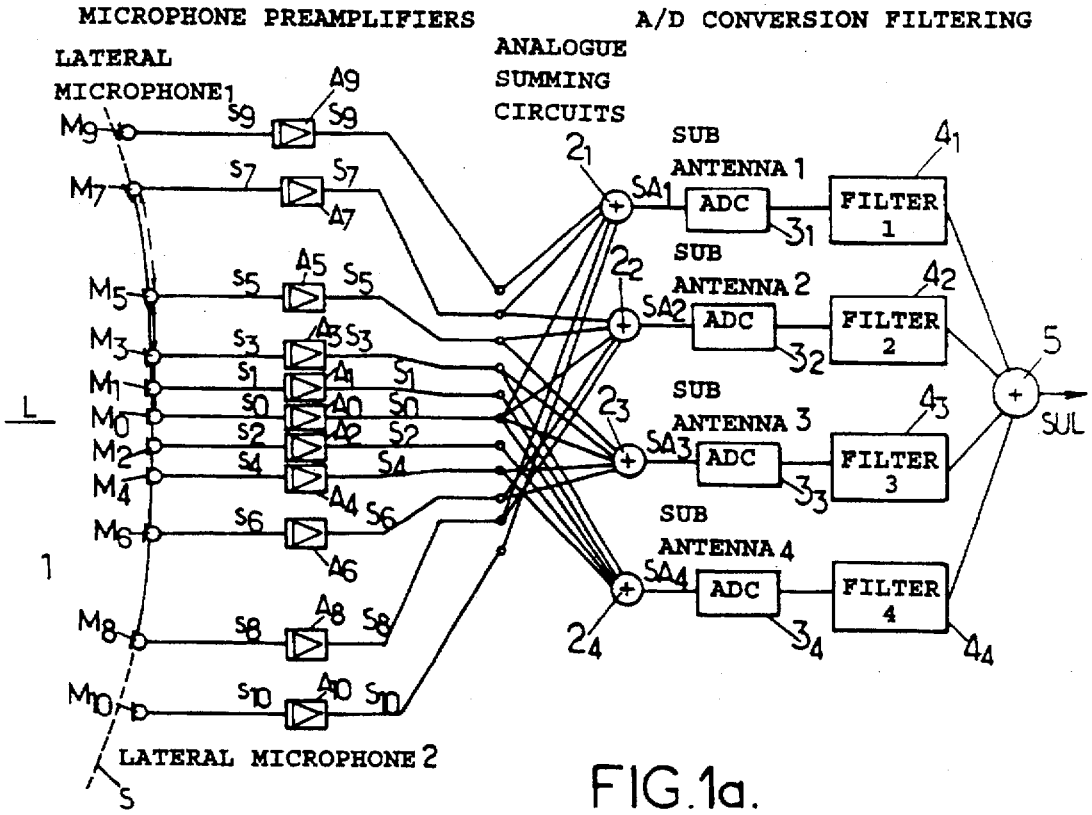
FIG.1a.
FIG.2.
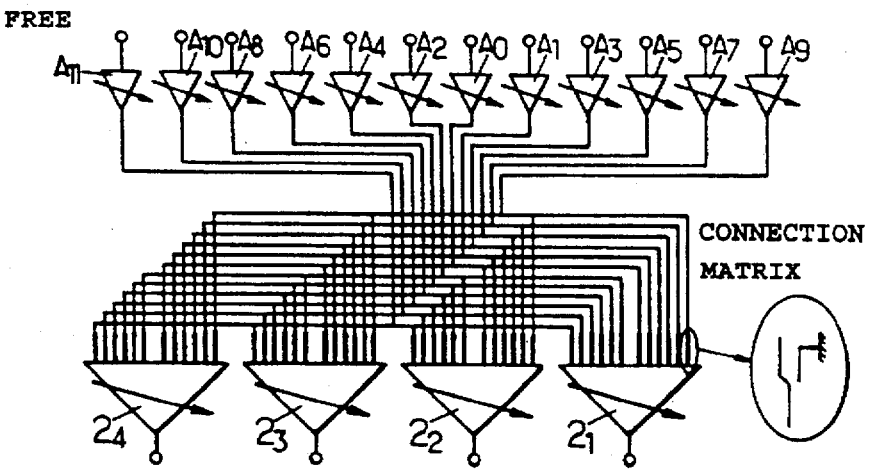

FIG.6b.
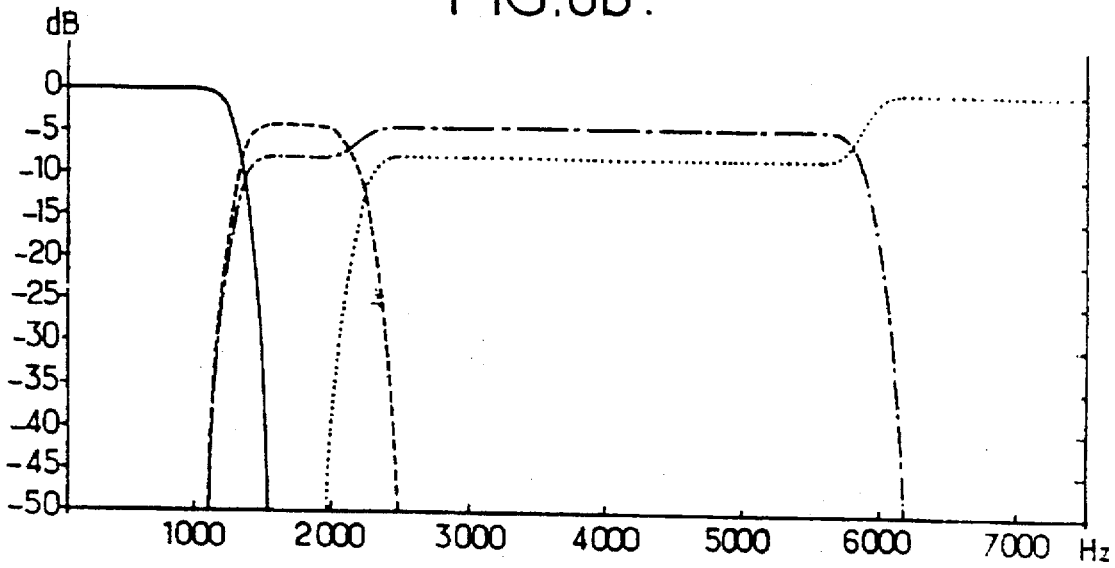
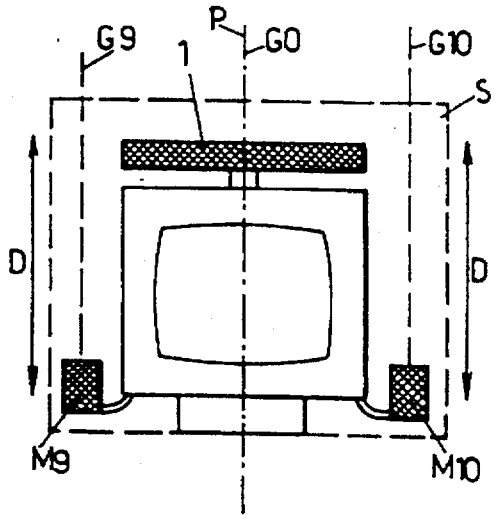
FIG.7a.
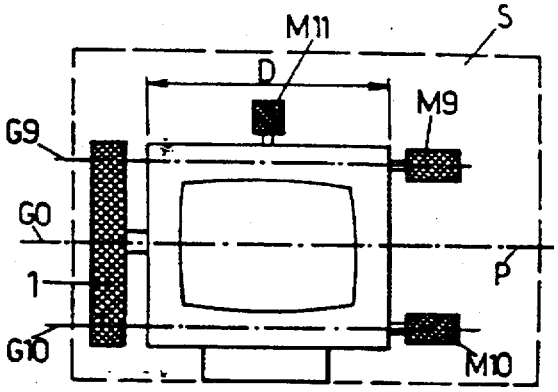
FIG.7b.

SYSTEM FOR SELECTIVE SOUND CAPTURE FOR REVERBERANT AND NOISY ENVIRONMENT

The invention relates to a system for selective sound capture for reverberant and noisy environment.

In the most recent telecommunication services, such as the teleconference and bands-free telephony services, as well as in multimedia computer workstation applications, sound capture is systematically disturbed by the acoustic environment, since the distance separating the speaker from the sound capture system is far greater than in conventional telphony. Thus, before being transmitted, the sound message, to which ambient noise is added, is modified and disturbed by the room effect, or reverberation phenomenon.

This phenomenon, as well as the greater relative magnitude of the noise, as compared with close sound capture, lessen the intelligibility of the message transmitted and give an impression of remoteness in listening.

Moreover, when two teleconferenced rooms are interconnected, the signal originating from the distant room is fed back into the sound capture system. This acoustic coupling is the origin of the echo phenomenon and of the instabilities of the electro-acoustic loop, known as the Larsen effect.

Unlike in-studio sound capture, the applications mentioned above occur in noisier sound environments which are uncontrolled from the acoustic point of view, in particular in the case of multimedia workstations.

In order to lessen these very troublesome effects, the use may be envisaged of directional microphones whose acoustic sensitivity diagram favours the direction of the useful source as compared with the other directions, sources of uncontrolled noise. However, the spatial selectivity of this type of conventional sensor, whose acoustic sensitivity diagram is of cardioid type for example, is inadequate to obtain a satisfactory reduction in noise and in room effect.

A more effective technique for resolving the aforesaid problems, posed by remote sound capture, consists in producing an acoustic antenna which in fact consists of an array of microphones whose output signals are summed. These microphones are, advantageously, laid out in such a way that the useful sound signals reach each of them at the same time and are therefore summed in phase. Speech or the useful signal is thus favoured as compared with the perturbing signals due to reverberation and sources of noise.

Generally, the art of acoustic antennas is much like the known arts of channel formation in radio antennas.

However, this art poses specific problems by virtue, on the one hand, of sound signals belonging to a broadband frequency spectrum, occupying several octaves for example from 100 Hz to 7500 Hz and, on the other hand, of the presence of near-field sound sources, for which the assumption of soundwave propagation, as plane waves, does not hold.

In order for the antenna to maintain constant performance versus frequency, one solution consists in breaking it up into sub-antennas, each characterized by a specific spacing between sensors or microphones and dedicated to one part of the global frequency band. The output signals of the sub-antennas are obtained by summing the signals delivered by the sensors. Limitation of each sub-antenna to its frequency band is then performed by a bank of band-pass filters. Such a device has been described in particular in the article published by Y. MAHIEUX, G. L. E. TOURNEUR, A. GILLOIRE, A. SALIOU, J.-P. JULLIEN, CNET LAA/TSS/CMC—Route de Trégastel, BP 40—LANNION CEDEX, France, and entitled "A microphone array for multimedia. workstations". Third international Workshop on Acoustic Control, Plestin-les-Grèves, France. September 1993.

The system described by the aforesaid article is satisfactory.

However, the practical production of such a system on an industrial scale poses numerous problems. In particular, the layout of the microphones or acoustic sensors directly influences the performance of the acoustic antenna. Relative to the wavelength, the physical size of this acoustic antenna should be as great as possible, so as to allow good spatial directivity. Such a characteristic poses numerous problems, in particular in the low frequency range.

The above requirement is all the more difficult to satisfy in applications relating to multimedia workstations, it not being possible for the overall dimensions of the antenna reasonably to exceed those of the video display monitor.

Finally, the acoustic antenna should, to allow easy industrialization and commercialization, be simple to install on any type of terminal in the absence of substantial modification to the latter.

The system for selective sound capture for reverberant and noisy environment, which is the subject of the present invention, includes a plurality of electro-acoustic transducers intended to receive in-phase useful sound signals arising from one and the same useful speaking area, the said useful sound signals being summed in phase and the sound signals originating from areas other than the useful area being summed out of phase in order to select the sound signals arising from the useful speaking area.

It is notable in that it includes, in combination, an aerial formed by a part with concave cylindrical surface. The concavity of the cylindrical surface being oriented towards the useful speaking area, the said plurality of electro-acoustic transducers being distributed over and in the vicinity of the said cylindrical surface, each electro-acoustic transducer being oriented towards the useful speaking area and delivering an analogue sound signal, the unit of the aerial and electro-acoustic transducers forming an acoustic antenna.

Means of partial summation of a plurality of analogue sound signals delivered by each of the electroacoustic transducers, according to a specified arrangement, this making it possible to form from the electro-acoustic transducers a plurality of elementary acoustic antennas each delivering a resultant elementary analogue sound signal, and circuits of summing the resultant elementary analogue sound signals so as to produce a resultant analogue sound signal representative of the sound signal arising from the useful speaking area.

The system for selective sound capture for reverberant and noisy environment, which is the subject of the invention, finds application in new telecommunication services such as teleconferencing, hands-free telephony and also to multimedia computerization and to tele-computerization.

Figure 1C:
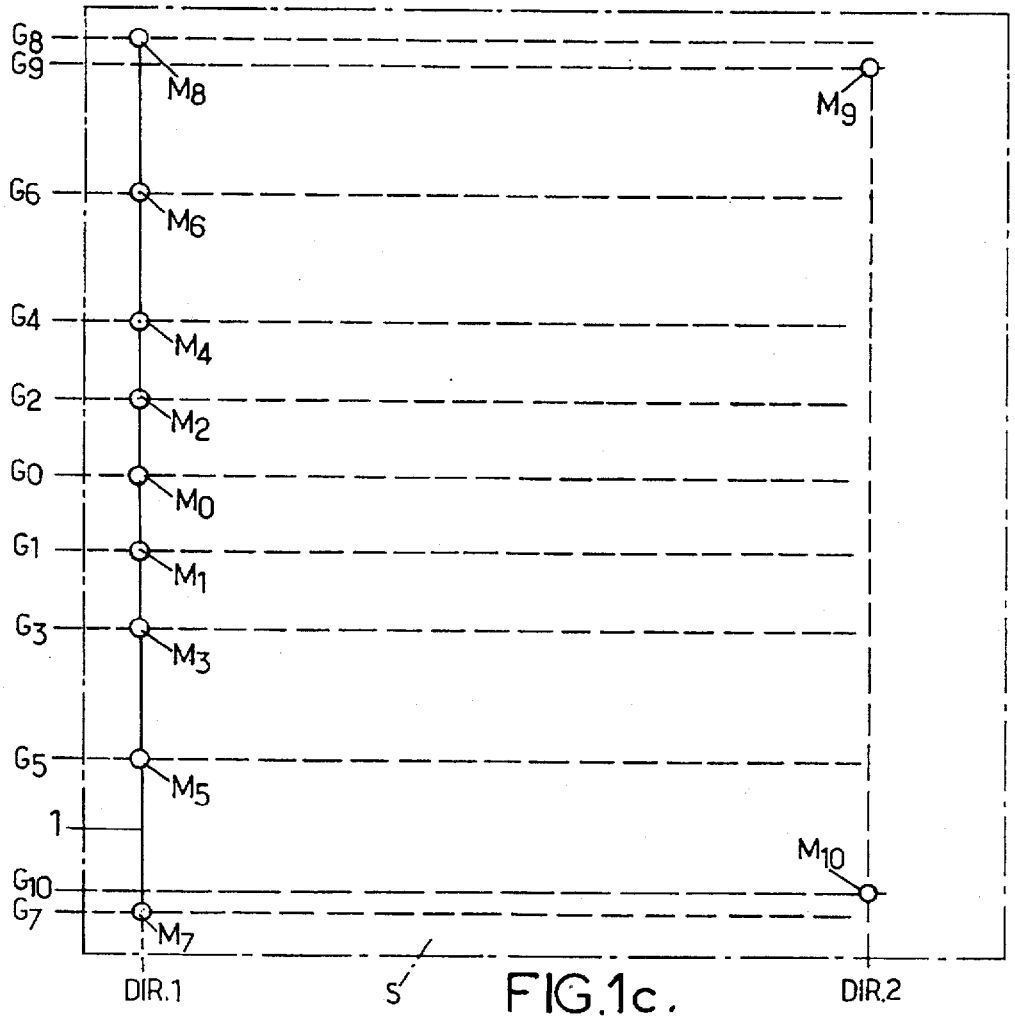
Figure 3:
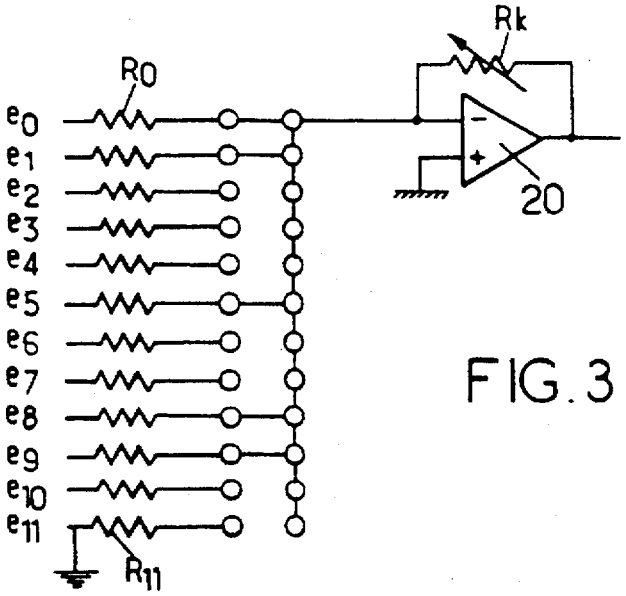
Figure 4A:
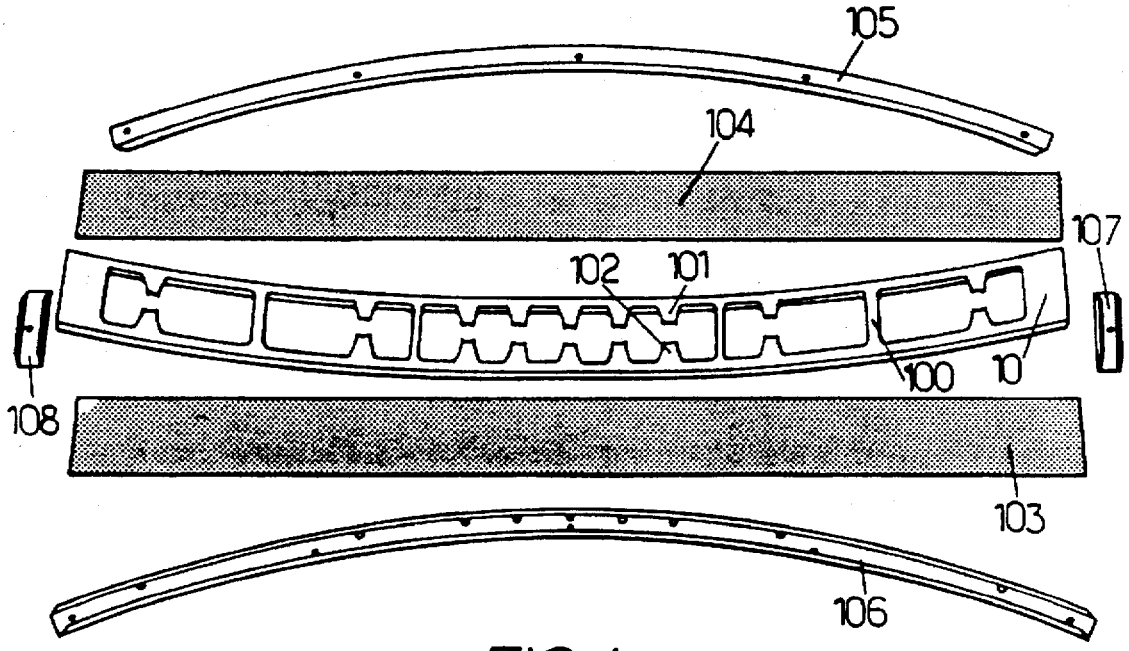
Figure 4B:
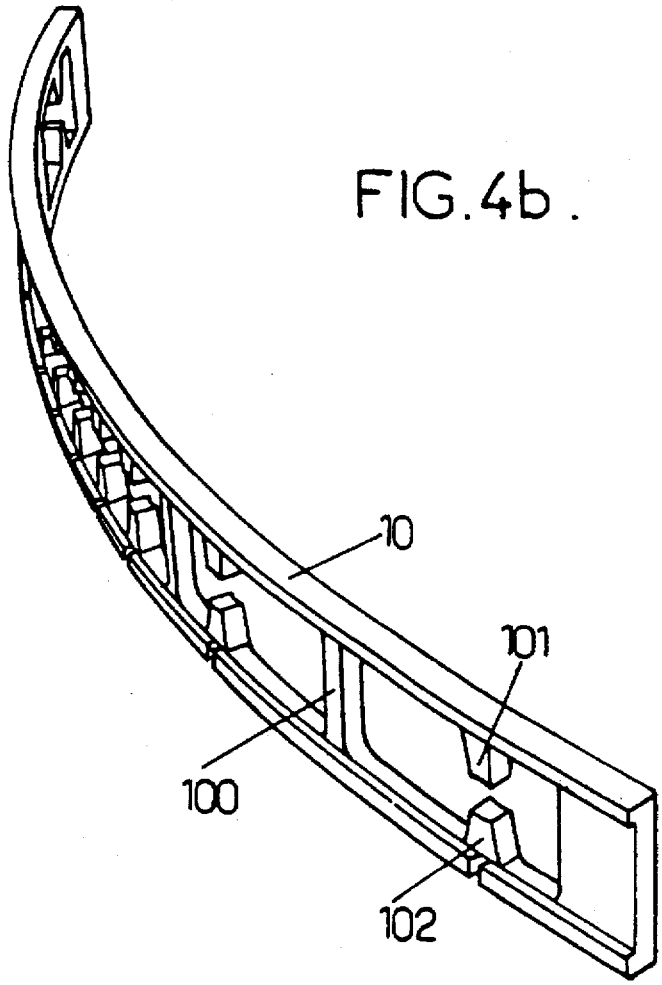
Figure 4C:
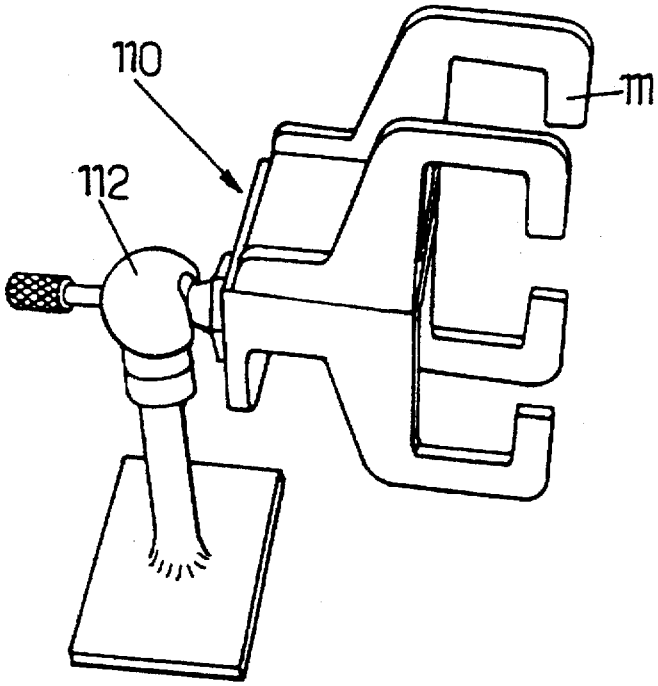
Figure 4D:
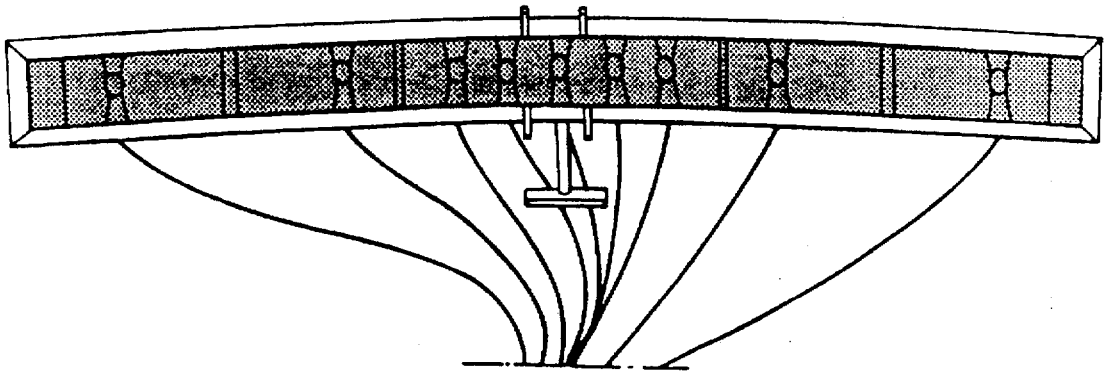
Figure 5A:
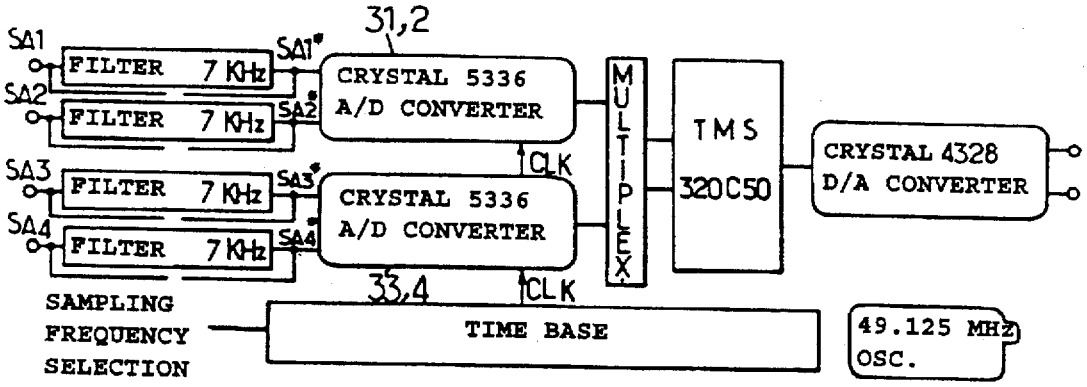
Figure 5B:
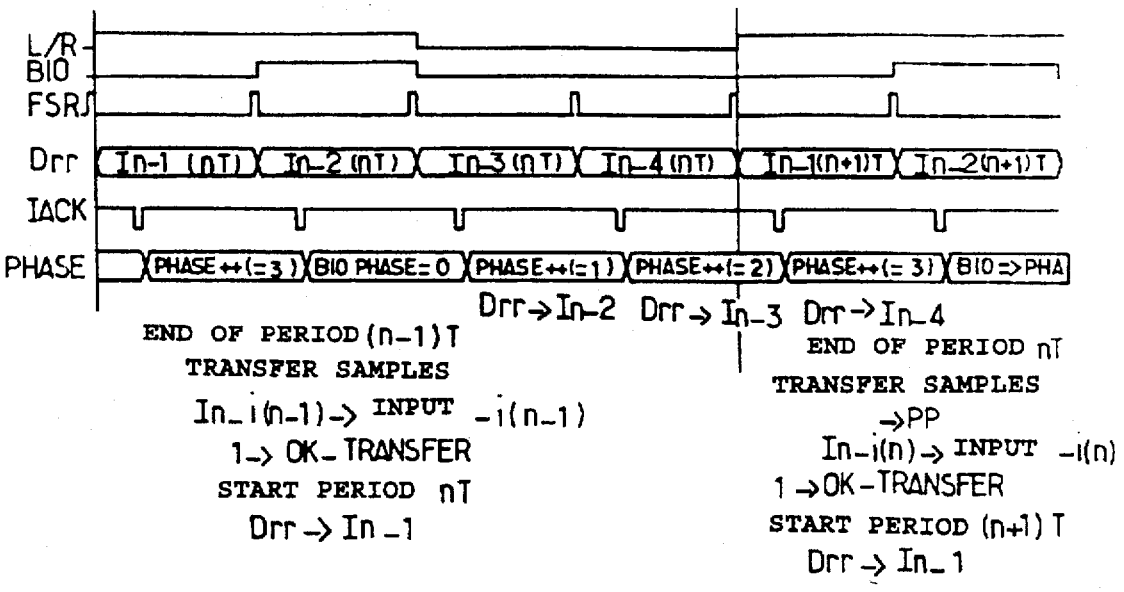
Figure 6A:
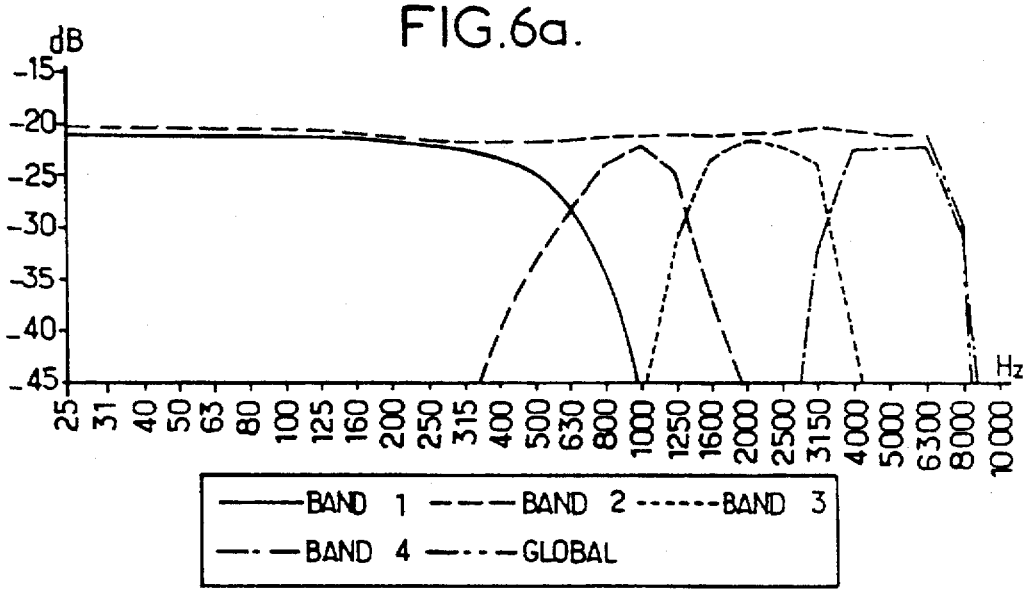

A more detailed description of the system for selective sound capture, which is the subject of the present invention, will be given below in conjunction with the drawings in which:

FIG. 1*a* represents a basic diagram of the system for selective sound capture, which is the subject of the present invention, FIGS. 1*b* and 1*c* represent a first respectively a second mode of disposition of electro-acoustic transducers able to be used to produce an acoustic antenna according to the subject of the present invention, FIG. 2 represents a basic diagram of analogue circuits for partial summation making it possible to constitute a plurality of elementary acoustic antennas, FIG. 3 represents an embodiment detail of a mixing circuit, FIG. 4*a* represents the mechanical elements in an exploded view, making it possible to embody the mechanical structure of the aerial, FIG. 4*b* represents a perspective view of the element central to the framework of the mechanical structure of the aerial, FIG. 4*c* represents a particular advantageous embodiment of the mechanical support of the aerial, FIG. 4*d* represents a front view of the acoustic antenna according to the invention, after mounting, FIG. 5*a* represents a block diagram illustrating the filtering process applied, by digital art, to the signals delivered by each elementary antenna, FIG. 5*b* represents a timing diagram of a circuit for serial interfacing of the circuits for summing the resultant analogue sound signals, FIGS. 6*a* and 6*b* represent a gain/frequency plot for the frequency response of filters corresponding to a conventional splitting and to an optimized splitting into elementary bands respectively, FIGS. 7*a* and 7*b* each illustrate a particular application of the system for selective sound capture, which is the subject of the present invention, to a multimedia workstation.

A more detailed description of the system for selective sound capture for reverberant and noisy environment, according to the subject of the present invention, will now be given in conjunction with FIG. 1*a*.

According to the aforesaid figure, the system, which is the subject of the present invention, includes a plurality of electro-acoustic transducers, denoted $M_0$ to $M_{10}$, intended to receive useful sound signals in phase, arising from one and the same useful speaking area, denoted L in the aforesaid figure. The electro-acoustic transducers $M_0$ to $M_{10}$ consist for example of microphones and are intended to receive the useful signals summed in phase, the sound signals originating from areas other than the useful area L being summed out of phase in order to select the sound signals arising from the aforesaid useful speaking area.

Of course, the electro-acoustic transducers $M_0$ to $M_{10}$ are of substantially unidirectional type, these microphones exhibiting a spatial sensitivity diagram of cardioid type for example.

According to a particularly advantageous characteristic of the system which is the subject of the present invention, the system includes in combination an aerial, denoted 1, formed by a part with concave cylindrical surface, this surface being denoted S in FIG. 1*a*. The concavity of the cylindrical surface S is oriented towards the useful speaking area L and the plurality of electro-acoustic transducers $M_0$ to $M_{10}$ is distributed over and in the vicinity of the aforesaid cylindrical surface S.

Each transducer $M_0$ to $M_{10}$ is oriented towards the useful speaking area L and delivers an analogue sound signal, the unit of the aerial and electro-acoustic transducers $M_0$ to $M_{10}$ forming an acoustic antenna. The analogue sound signals delivered by each electro-acoustic transducer are denoted s0 to s10 respectively. Advantageously, it is indicated that each electro-acoustic transducer is connected to a preamplifier, denoted $A_0$ to $A_{10}$, which delivers an amplified analogue sound signal, denoted $S_0$ to $S_{10}$.

Circuits for partial summation of a plurality of the aforesaid analogue sound signals, in particular the amplified analogue sound signals $S_0$ to $S_{10}$, are provided, these circuits bearing the reference $\mathbf{2}_1$, $\mathbf{2}_2$, $\mathbf{2}_3$ and $\mathbf{2}_4$ in FIG. 1. The partial summation of the plurality of amplified analogue sound signals $S_0$ to $S_{10}$ is performed according to a specified arrangement of these signals, this making it possible to form, from the aforesaid electro-acoustic transducers, a plurality of elementary acoustic antennas, more commonly designated as sub-antennas, each sub-antenna delivering a resultant elementary analogue sound signal. These signals being denoted $SA_1$, $SA_2$, $SA_3$ and $SA_4$ in FIG. 1*a*.

In a first simplified version for producing the system for selective sound capture, which is the subject of the present invention, it is indicated that the resultant analogue signals $SA_1$ to $SA_4$ delivered by the aforesaid summing circuits $\mathbf{2}_1$ to $\mathbf{2}_4$ in the form of analogue signals can be maintained in this form. In such a case, following analogue filtering $\mathbf{4}_1$ to $\mathbf{4}_4$, a circuit 5 for summing these resultant elementary analogue sound signals is provided in order to produce a resultant analogue sound signal representative of the sound signal arising from the useful speaking area L mentioned earlier. This signal is denoted SUL in FIG. 1*a*.

In a more elaborate version for producing the system for selective sound capture, which is the subject of the present invention, it is indicated that, for reasons of simplification and improvement of the flexibility of processing, each of the resultant elementary signals $SA_1$ to $SA_4$ is subjected successively to an analogue digital conversion process by way of analogue digital converters $\mathbf{3}_1$ to $\mathbf{3}_4$, then to a filtering by means of digital filters, denoted $\mathbf{4}_1$ to $\mathbf{4}_4$. These analogue digital conversion and digital filtering processes can be carried out by processes of conventional type but make it possible, however, to improve the global performance of the antenna, as will be described later in the description. In this case, the summation circuit 5 can be embodied in digital form.

Generally, it is indicated that the system for selective sound capture, which is the subject of the present invention, is produced such that the spacings between electro-acoustic transducers $M_0$ to $M_{10}$ are chosen such that the total number of aforesaid electro-acoustic transducers is minimized, thereby creating an antenna said to have logarithmic spacing.

As represented in FIG. 1*a*, the electro-acoustic transducers can be distributed so as to have a central transducer, the transducer $M_0$, as well as transducers adjacent to this central transducer, laid out over the aerial 1 symmetrically relative to the central transducer $M_0$.

By way of example, it is indicated that the transducer $M_1$ is a distance of 2.5 cm distant from the central transducer $M_0$, the transducer $M_3$ is the same distance of 2.5 cm distant from the transducer $M_1$, the transducer $M_5$ is a distance of 5 cm distant from the transducer $M_3$ and the transducer $M_7$ is a distance of 10 cm distant from the transducer $M_5$, these transducers being placed on a director line of the aforesaid surface S. Of course, the transducers with even index $M_2$ to $M_8$ are symmetric with respect to the central transducer $M_0$ relative to the corresponding transducers $M_1$ to $M_7$.

Furthermore, it is indicated that two at least of the electro-acoustic transducers, such as the transducers $M_9$ and $M_{10}$, are situated in the vicinity of the surface S but are mechanically uncoupled from the aerial 1.

Advantageously and so as to improve the directivity of the acoustic antenna, which is the subject of the present invention, thus formed, it is indicated that the endmost electro-acoustic transducers, such as the transducers $M_9$ and $M_{10}$, are placed at a distance of around 30 cm from the end transducers situated on the aerial 1, that is to say the transducers $M_7$ and $M_8$. Advantageously, so as to satisfy the previously mentioned distance condition, without however prohibitively increasing the envelope of the antenna thus formed, it is indicated that the endmost transducers $M_9$ and $M_{10}$ may be placed on a generator line of the surface S, near the generator lines of this same surface S supporting the end transducers $M_7$ and $M_8$ placed on the aerial 1. It is understood, as represented in FIG. 1*a*, that the distance apart of the endmost transducers $M_9$ and $M_{10}$ relative to the end transducers of the aerial 1, the transducers $M_7$ and $M_8$, in the direction of a director line of the surface S, can be very small, of the order of 4 to 5 cm, thus making it possible consequently to lessen the envelope of the acoustic antenna thus formed while maintaining the condition of distance between the endmost transducers $M_9$ and $M_{10}$ and the end transducers of the aerial 1, $M_7$ and $M_8$.

Generally, it is indicated that the layout of the electro-acoustic transducers or microphones directly influences the performance of the acoustic antenna thus produced.

Referred to the wavelength, the physical size of this antenna should be as great as possible to allow the best possible spatial selectivity.

Such a constraint poses problems in the low frequency range, the envelope of multimedia workstations for example is required not to be increased to excess.

A more detailed description of a disposition of the microphones, or electro-acoustic transducers mentioned earlier, will be given in two particularly advantageous embodiments in the case of FIGS. 1*b* and 1*c* respectively.

In the two cases of the aforesaid embodiments, it is indicated that the electro-acoustic transducers are distributed as a first, $M_0$ to $M_8$, and as a second group, $M_9$ and $M_{10}$, of electro-acoustic transducers.

There is an odd number of electro-acoustic transducers $M_0$ to $M_8$ in the first group, aligned on a line of the curvilinear surface S parallel to a director line of the cylindrical part, the director line Dir 1 in FIGS. 1*b* and 1*c*. It is of course understood that the electro-acoustic transducers of the first group are placed symmetrically with respect to a plane of symmetry containing a generator line, the line $G_0$ in FIGS. 1*b* and 1*c*, of the cylindrical surface S, this plane of symmetry also containing the central electro-acoustic transducer $M_0$.

As regards the electro-acoustic transducers of the second group, the transducers $M_9$ and $M_{10}$, it is indicated that they are distributed over one or more director lines of the aforesaid concave cylindrical surface S.

Thus, in the case of the embodiment of FIG. 1*b*, the case in which the electro-acoustic transducers $M_0$ to $M_8$ are placed on the horizontal director line Dir 1 of the surface S, the transducers of the second group $M_9$ and $M_{10}$ can be placed on a common director line Dir 2 of the surface S, each of them being placed on a distinct generator line $G_9$, respectively $G_{10}$. It is understood that in the embodiment of FIG. 1*b*, the condition of distance between the endmost electro-acoustic transducers $M_9$, $M_{10}$ relative to the end transducers of the aerial 1, $M_7$ and $M_8$, is satisfied without, however, the global envelope of the acoustic antenna thus formed being increased prohibitively.

In the case of the embodiment of FIG. 1*c* on the contrary, the transducers of the first group, $M_0$ to $M_8$, are of course still placed on a director line, the line Dir 1 of the surface S, this director line being vertical this time. In such a case, the transducers of the second group, $M_9$ and $M_{10}$, can advantageously be placed on the same director line Dir 2, and on two distinct generator lines, denoted $G_9$ and $G_{10}$, this making it possible of course to satisfy the condition of distance of the endmost electro-acoustic transducers $M_9$ and $M_{10}$ relative to the end transducers $M_7$ and $M_8$ of the aerial 1, without however increasing to excess the global envelope of the acoustic antenna thus constituted.

It is of course indicated that in the above embodiment, the electro-acoustic transducer $M_{10}$ for example can be placed on the generator line $G_{10}$ symmetrically with the electro-acoustic transducer $M_9$ with respect to the generator line $G_0$.

The electro-acoustic transducers being laid out as represented in FIGS. 1*a* and in particular 1*b* and 1*c*, it is indicated that each is connected to an electronic preamplifier with adjustable gain, denoted $A_0$ to $A_{10}$, this type of preamplifier possibly being formed by an operational preamplifier for example.

Furthermore, so as to constitute the elementary antennas or the sub-antennas mentioned earlier, it is indicated that the output of each of the aforesaid preamplifiers $A_0$ to $A_{10}$ is connected to certain inputs of the summation circuits $2_1$ to $2_4$, as illustrated in FIG. 1*a*.

More specifically, it is indicated that, so as to constitute the successive sub-antennas, the connections are produced as follows:

sub-antenna 1:

$A_9$ $A_7$ $A_0$ $A_8$ $A_{10}$/Summing circuit $2_1$.

In this case, it is indicated that the sub-antenna 1 is formed from the endmost transducers $M_9$ and $M_{10}$, from the end transducers of the aerial 1, $M_7$ and $M_8$, and from the central transducer $M_0$. The sub-antenna 1 thus formed by way of the aforesaid electro-acoustic transducers and the summing circuit $2_1$ corresponds to the sub-antenna which is sensitive to low frequencies, as will be described later in the description.

sub-antenna 2:

$A_7$ $A_5$ $A_0$ $A_6$ $A_8$/Summing circuit $2_2$.

The sub-antenna 2 thus formed from the aforesaid electro-acoustic transducers and from the summing circuit corresponds to a sub-antenna which is sensitive to the signals at lower middle frequency, as will be described later in the description.

Sub-antenna 3:

$A_5$ $A_3$ $A_0$ $A_4$ $A_6$/Summing circuit $2_3$.

The sub-antenna 3 thus formed is sensitive to the signals at upper middle frequency, as will be described later in the description.

Sub-antenna 4:

$A_3$ $A_1$ $A_0$ $A_2$ $A_4$/Summing circuit $2_4$.

The sub-antenna 4 thus formed is sensitive to the high frequencies, as will be described later in the description.

The sub-antenna 1, sub-antenna 2, sub-antenna 3, sub-antenna 4, mentioned above, respectively deliver the elementary resultant analogue sound signals, namely the signals $SA_1$, $SA_2$, $SA_3$, $SA_4$ mentioned earlier.

So as to facilitate the interconnection of each of the amplifiers $A_0$ to $A_{10}$ to the respective inputs of the aforesaid s-mining circuits $2_1$ to $2_4$, it is advantageous, as represented in FIG. 2, to produce a connection matrix advantageously including a battery of twelve preamplifiers in parallel, denoted $A_0$ to $A_{11}$, each preamplifier with adjustable gain being connected by way of a connection matrix such as represented in FIG. 2, to the four s-mining circuits, denoted $2_1$ to $2_4$. As a practical matter, it is indicated that the channel constituted by the preamplifier $A_{11}$ can be a free channel, the latter for convenience being provided and then possibly being connected to the reference voltage of the device. Each summing circuit $2_1$ to $2_4$ call consist, as represented in FIG. 3, of an operational amplifier 20 whose positive input is connected to the reference voltage and whose negative input is connected in feedback through an adjustable resistor Rk. The negative input of the operational amplifier 20 is connected in a conventional manner to twelve resistors in parallel, denoted $R_1$ to $R_{12}$, by means of connection bridges, which make it possible to configure the corresponding summing circuit $2_1$ to $2_4$ according to a desired configuration. It is indicated that, as regards the summing circuit represented in FIG. 3, the summing circuit corresponds to the sub-antenna 2 for example, the inputs $e_0$, $e_1$, $e_5$, $e_8$ and $e_9$ being connected to the negative input of the operational amplifier 20 operating in summation mode, and, respectively, to the preamplifiers $A_0$, $A_5$, $A_6$, $A_7$, $A_8$.

Of course, and in a non-limiting manner, it is indicated that, with each aforesaid elementary acoustic antenna or sub-antenna, is moreover associated a means of low-pass, band-pass or high-pass frequency filtering as a function of the rank of the aforesaid sub-antenna, the frequency bands transmitted by each filter associated with an elementary acoustic antenna being offset so as to cover a resultant pass band covering frequencies lying for example between 25 Hz and 7500 Hz. The operational mode of the filtering proper will be described later in the description.

A more detailed description of the implementation of the structure of the aerial 1 will now be given in conjunction with FIGS. 4*a*, 4*b*, 4*c* and 4*d*.

According to a particularly advantageous aspect of the acoustic antenna, which is the subject of the present invention, it is indicated that the acoustic antenna, so as to obtain the lowest possible production costs, implements electro-acoustic transducers consisting of microphone capsules of bare electret type instead of complete sensors which traditionally include, apart from the capsule proper or sensing element of the microphone, a protective shield, a fixing device and connection elements as well as a package with a view to electrical supply.

Given the use of the aforesaid microphone capsules of bare electret type, the practical embodiment of the aerial 1 presented the following technical problems:

- mechanical problems of fixing the capsule to the support of the antenna or aerial 1,
- sensitivity of the unit to electromagnetic fields by virtue of the absence of shielding of the capsules used, this type of capsule of course being sensitive to electromagnetic radiation,
- repercussions on the directivity, and hence on selective sound capture, the directivity diagram of each of the capsules used being required never to be impaired by mounting on the aerial 1.

Given the aforesaid problems, the embodying of the mechanical structure constituting the aerial 1 such as described in conjunction with the aforesaid figures, makes it possible to resolve all of these problems.

As represented in FIG. 4*a*, the aerial 1 or part with cylindrical surface, is formed by a framework, denoted 10, of substantially rectangular shape made of plastic. This framework 10 is furnished with spacers 100 and with opposing teeth 101, 102 formed in the plane of the above-mentioned framework 10. Two opposing teeth form a housing intended to receive en electro-acoustic transducer, that is to say the microphone capsules $M_0$ to $M_8$ mentioned earlier in the description. Of course, as is apparent on examining FIG. 4*a*, the framework 10 is bent so as to form the part with cylindrical surface mentioned earlier.

Furthermore, the acoustic antenna, which is the subject of the present invention, comprises, in the region of the aerial 1, en electromagnetic shield making it possible to ensure immunity of the electro-acoustic transducers to electromagnetic perturbations or disturbances. In FIG. 4*a*, the electromagnetic shield consists of a metal grid, in fact of two metal grids bearing the references 103 and 104, these grids covering the concave part and the convex part of the part with cylindrical surface, that is to say ultimately the rectangular framework 10 mentioned above, and of course, the electro-acoustic transducers when the latter have been placed in the housings provided and intended to receive them. Of course, the metal grid 103, 104 is electrically connected to the electric reference potential of the electro-acoustic transducers.

Assembly of the aerial 1 is carried out by means of four ties, also made of plastic, bearing the references 105, 106, 107 and 108, these plastic ties exhibiting a shape suitable to ensure assembly of the framework 10, furnished with its electro-acoustic transducers and with the overlapping electromagnetic shielding grids 103 and 104, the ties then being fixed to the periphery of the framework 10 to form a compact unit. The aforesaid ties are fixed by screws for example to the framework 10.

The main role of the framework 10 is to hold the electro-acoustic transducers $M_0$ to $M_8$. Its geometry therefore corresponds to that of the aerial 1 and of the antenna, the plastic mount constituting the framework therefore being bent into an arc of a circle as represented more meaningfully in FIG. 4*b*. The structure represented in FIG. 4*b* in respect of the framework 10 has the advantage of good sturdiness in the longitudinal direction as well as acoustic transparency, the mechanical structure thus formed causing no impairment of the acoustic characteristics of the electro-acoustic transducers inserted into the housings formed between two teeth 101, 102.

The framework 10 can be made from PVC (polyvinyl chloride), an impact- and abrasion-resistant atactic polymer material which is easily machined. The four ties mentioned earlier 105, 106, 107, 108 thus surround the framework 10, reinforcing the mechanical sturdiness of the latter.

The framework 10 is the part of the mechanical unit which has the greatest effect on the acoustic transparency. This transparency can be obtained only if the framework 10 is as void as possible so that the capsules are clear of its hardware structure. Indeed, in the contrary case, the disturbances of the acoustic field modify the inherent directional characteristics of the electret capsules. This is why the framework 10 as represented in FIGS. 4*a* and 4*b* has the voided structure between the teeth and the spacers mentioned earlier. Tests carried out in the laboratory have shown that electrets exhibiting a sensitivity diagram of cardioid type became omnidirectional in the event that, no precaution being taken, they were inserted into a framework of solid structure.

In a preferred non-limiting embodiment, the framework 10 is formed by a single piece with dimensions L=490 mm, 1=40 mm and H=6 mm, machined as represented in FIG. 4*b*. The length L of the framework 10, that is to say the longitudinal dimension of the latter, corresponds to the aperture of the acoustic antenna. The width 1 addresses mechanical considerations such as the holding of the electro-acoustic transducers, and acoustic and aesthetic considerations. Finally, the thickness h of the framework 10 is equal to that of the electret capsule inserted into each housing made between two teeth 101, 102.

The holding of the microphone capsules can be ensured by truncated triangle shapes in the region of the tip of the teeth 101, 102, it being possible for the truncation of each triangle to be rounded by drilling. The drilling diameter is then chosen so as to allow the force-fixing of the electret capsules into the housings thus constituted at the tip of the teeth 101, 102. This machining and the manner of fixing each capsule are identical for all the capsules.

The sturdiness of the framework 10 is obtained by retaining material constituting the spacers 100 of width equal, for example, to 5 mm. These spacers forming stiffeners are four in number and may be situated advantageously at the abscissae ±5 cm, ±10 cm on the arc of a circle, taking as origin tho position of the central electro-acoustic transducer $M_0$. In the central part of the antenna and consequently of the framework 10, it is unnecessary to provide any stiffener or spacers 100 by virtue of the small distance between microphones and of the assigning of the latter to the elevated frequencies. Indeed, the disturbances of directivity of the electro-acoustic transducers owing to obstacles are stronger at elevated frequencies than at low frequencies.

When machining the piece constituting the framework 10, the recesses can be made on a straight piece before bending, the radius of curvature of the framework 10 being obtained subsequently by hot bending.

The ties 105, 106, 107, 108 can be formed from a copolymer material called high-impact polystyrene (SB). Of U-shaped cross-section, the ties consist of the four aforesaid elements, which surround the framework 10 and are fixed to it. The main role of the ties is to reinforce the mechanical rigidity of the unit. The ties 105, 106, 107 and 108 can be made by thermoforming, a technique applicable to thermoplastics such as high-impact polystyrene, whilst allowing the formation of ties of small size but exhibiting good mechanical toughness.

As regards the electromagnetic shielding grids 103 and 104, it is indicated that they are made necessary by virtue of the absence of specific shielding of each electro-acoustic transducer used. The absence of electromagnetic shielding has the effect of introducing deleterious spectral lines at $_{50}$ Hz and at the harmonics of this frequency in the spectrum of the output signal from the unshielded electro-acoustic antenna. The aforesaid electromagnetic shielding grids make it possible to suppress such a deleterious phenomenon. However, the aforesaid grids should be acoustically transparent, easy to implement and should correspond perfectly to the mechanical structure of the aerial 1.

The two electromagnetic shielding grids 103 and 104 are formed by two tinned metal grids surrounding the framework 10 of the aerial 1. The two aforesaid grids overlap the ends of the framework 10 and the electrical earth of each electret capsule forming an electro-acoustic transducer is connected to the aforesaid grids by an earth wire.

The grids 103 and 104 are made of micromesh expanded metal made from a material such as brass, 490 mm long and 40 mm wide, and have diamond-shaped openings of dimensions 1.45×0.25 mm. They are 0.2 mm thick and therefore have a slenderness which allows close matching of the shape of the mechanical structure of the aerial 1, electrical contact being ensured at the end of the latter. The mesh dimensions of the aforesaid grids are entirely satisfactory to ensure effective electromagnetic shielding.

The previously mentioned metal grids forming the electromagnetic shielding furthermore exhibit very good quality acoustic transparency. This condition holds by virtue of the void/solid ratio of the grid, which is much greater than 50%.

Finally, it is indicated, as represented in FIG. 4*c*, that the aerial 1 can then be installed for example on the video monitor of a workstation with the aid of a support 110, such as represented in the aforesaid figure, which includes a claw, denoted 111, for fixing the aerial 1, the unit being mounted on a knuckle joint 112 allowing the aerial and in particular its axis of symmetry to be oriented towards the speaking area L. The claw 111 is formed be a double clamp which grips the aerial 1 in the region of the ties. The knuckle joint 112 is formed by a ball which can be locked by screws, allowing orientation on request. The slenderness of the armature ensures the acoustic transparency of the unit.

Represented in FIG. 4*d* is a view of the complete aerial 1, the capsules being in place but the electromagnetic shielding grid 104 being omitted so as to show the interior appearance of the unit.

As regards the two endmost electro-acoustic transducers, $M_9$ and $M_{10}$, these can be placed in a structure similar to the framework 10 represented in FIG. 4*b* but of greatly reduced dimensions since it is sufficient for the corresponding structure in fact to exhibit a single pair of teeth 101, 102 to ensure the placement of the electret capsule forming the electro-acoustic transducer. It is then indicated that the elementary aerials thus formed, for the electro-acoustic transducers $M_9$ and $M_{10}$, can be placed on one or both sides of the video monitor of a multimedia workstation for example, as will be described later in the description, the only condition to be met being the condition of distance D of the order of 30 cm relative to the aerial 1. It is indicated in fact that the electro-acoustic transducers $M_9$ and $M_{10}$ are intended for the low frequencies for which the positioning errors are less critical.

A more detailed description of the electronic elements required to implement the acoustic antenna, which is the subject of the present invention, will now be given in conjunction with FIGS. 5*a*, 5*b* and 6*a*, 6*b*.

Generally, it is indicated that the preamplifiers $A_0$ to $A_{10}$ can be embodied via operational amplifiers as already mentioned earlier in the description. However, and so as to ensure the polarizing of the electret capsules constituting the electro-acoustic transducers used to implement the acoustic antenna, which is the subject of the present invention, and the amplification of the signals delivered by them, it is indicated that these preamplifiers could be the subject of a mounting of differential type, each preamplifier possessing a gain adjustment making it possible to compensate for the differences in effectiveness of the various electret capsules. This type of differential mounting will not be described in detail since it can correspond to a scheme of conventional type normally used to ensure the supplying and discrimination of the analogue sound signals delivered by an electret capsule normally used in the corresponding technique.

As regards the filtering of the signals delivered by each sub-antenna, the signals $SA_1$, $SA_2$, $SA_3$ and $SA_4$ of FIG. 1*a*, a particular advantageous embodiment will be described within digital art allowing a very great flexibility of implementation and the best effectiveness of filtering.

Thus, as represented in particular in the aforesaid FIG. 1*a*, each summing circuit $2_1$, $2_2$, $2_3$, $2_4$ is followed for example in a basic diagram by an analogue digital converter $3_1$, $3_2$, $3_3$, $3_4$ and connected in cascade to each of these analogue digital converters by a filter $4_1$, $4_2$, $4_3$, $4_4$. The output of each filter is then connected to the summation circuit 5 making it possible to deliver the resultant analogue sound signal SUL.

In a preferred embodiment represented in FIG. 5*a*, it is indicated that the set of four analogue digital converters $3_1$, $3_2$, $3_3$, $3_4$ and four filters $4_1$, $4_2$, $4_3$, $4_4$ can be replaced advantageously by a filtering processing chain such as represented in the aforesaid FIG. 5*a*.

As represented in this figure, it is indicated that the signals delivered by each sub-antenna $SA_1$, $SA_2$, $SA_3$, $SA_4$ are each delivered to a low-pass analogue filter with cutoff frequency 7 kHz, each of the analogue filters delivering a corresponding filtered signal, denoted $SA_{1*}$, $SA_{2*}$, $SA_{3*}$, $SA_{4*}$.

Advantageously, the analogue digital conversion of the aforesaid filtered signals is performed by means of dual-channel analogue digital converters marketed for example under the brand name CRYSTAL reference 5356, these dual-channel converters, two in number and bearing, by analoguey with FIG. 1*a*, the reference $3_{1,2}$, respectively $3_{3,4}$, and the signals $SA_{1*}$, $SA_{2*}$, respectively $SA_{3*}$, $SA_{4*}$ in digital form. A time-division multiplexing circuit is provided, which receives the aforesaid signals delivered by the two analogue digital converters $3_{1,2}$, respectively $3_{3,4}$, this multiplexing circuit delivering the various aforesaid frames to a signal processor of TMS 320C50 tape marketed by TEXAS INSTRUMENTS. A 49.152 MHz oscillator makes it possible to drive a time base enabling signals of sampling frequency to be delivered to the aforesaid analogue digital converters. At the output of the signal processor, a digital analogue converter circuit of the type marketed for example under the brand name CRYSTAL reference 4328, makes it possible to restore the signal in analogue form, the summation being performed beforehand within the signal processor.

The operation of the unit of the device represented in FIG. 5*a* is as follows:

The analogue digital conversion performed by the converters $3_{1,2}$ and $3_{3,4}$ is performed at the same time starting from the same sampling clock signal CLK delivered by the time base so as to keep perfect synchronism between the various sub-antennas. Each of the aforesaid analogue digital converters $3_{1,2}$ respectively $3_{3,4}$ delivers the digitized data in an independent serial train.

The specific nature of the embodiment due to the large amount of data to be processed, both in analogue and in digital, is stressed here. Indeed, the current audiodigital circuits have hitherto only allowed the development of analogue digital converters of stereo type with two channels, and not with four channels as represented in FIG. 5*a*.

It is of course understood that the digital processor makes it possible to perform the various digital filtering operations regarding the multiplexing on the digital data trains each corresponding to the data and hence to the signals delivered by each of the sub-antennas. Multiplexing is thus performed without any offsetting of the sampling clock signals by virtue of the embodying of a specific time base together with a start-of-frame tagging system, so as to retrieve the signals pertaining to each of the channels in the corresponding order for the same given sampling instant.

As represented in FIG. 5*b*, graduated as abscissae in relative values of time and as ordinates in 01 logic values of the corresponding signals, the signals below represent:

- L/R, the sampling clock signal of the two input analogue digital converters, namely the converters $3_{1,2}$ respectively $3_{3,4}$,
- BIO, a start of frame or of data train time synchronization signal for each sampling instant, forwarded to the signal processor DSP,
- FSR, a control signal to start the recording in the signal processor DSP of the train of digital values corresponding to a channel or sub-antenna for the running sampling instant nT, for example,
- Drr, the digital values of the signals delivered by each of the channels or sub-antennas for the running sampling instants nT, respectively (n+1)T,
- Iack, the response of the signal processor to the start of recording signal FSR,
- Phase, the corresponding processing of each of the trains represented by the signal Drr by the signal processor.

The operation of the unit is as follows: following the appearance of the signal of FSR, the recording of each train corresponding to a sampling instant is performed at the level of the signal processor, then, upon an interrupt generated at the level of the signal processor, the filtering processing is performed by the latter, the signal Iack representing a response to this interrupt and therefore to the filtering performed for each of the data trains represented by the signal Drr. The signals delivered by the signal processor, in which a summation has been performed, are next subjected to digital analogue conversion.

Specifically, it is indicated that the filtering performed by the signal processor is carried out in digital form in preference to analogue filtering for reasons of flexibility of design. The sum of the filters applied to each of the corresponding signals delivered by the sub-antennas is equal to unity for all the frequencies, these filters being required not to introduce any impairment of the signal. These filters are also of restricted size so as to maintain a reasonable complexity of computation.

The filters may be designed according to various criteria. In a first approach such as represented in FIG. 6*a*, each filter thus embodied by the filtering by the signal processor is a filter of conventional bandpass type whose cutoff frequencies are chosen so that each sub-antenna is restricted to its own frequency band. FIG. 6*a* depicts the frequency responses of the filters thus adopted. Finite impulse response FIR filters having for example 31 coefficients are used for this purpose. These filters are then synthesized by means of a conventional FIR filter design procedure. An iterative algorithm ensures that the sum of the filters is equal to unity for all frequencies, the transfer function of each of the filters being tightly restricted to its own frequency band. For a more complete description of this type of filtering reference may be made to the article mentioned in the introduction to the description.

A second approach consists in employing filters such as to minimize a specified criteria, which can for example correspond to minimizing the energy received outside the area in which the speaker is located. The linear combination of the sub-antennas which minimizes the aforesaid criteria is then calculated for each frequency. This calculation can be carried out with the aid of well-known optimization procedures. On completing this phase, the frequency response of the filters to be applied to each sub-antenna is available and it is then sufficient, in order to ascertain the impulse responses, to use conventional filter calculation procedures.

FIG. 6*b* depicts the frequency responses of the filters resulting from the aforesaid optimization. The filters thus embodied make it possible to minimize the energy received which originates from directions external to the useful area of aperture defined as an area of ±60° in the plane containing the electro-acoustic transducers $M_0$ to $M_8$. These filters have a length of 128 coefficients. The second embodiment as represented in FIG. 6*b* makes it possible to enhance the directivity of the antenna under the conditions indicated earlier.

An acoustic antenna of particularly high performance, insofar as it is capable of being used for multimedia workstations for example, has thus been described.

In such a case, as represented in FIG. 7*a* or 7*b*, it is understood, in a first mode of application, that the aerial i can be placed on the video display monitor whilst the electro-acoustic transducers $M_9$ and $M_{10}$ are placed in the vicinity of the sides of this monitor symmetrically with respect to the main axis of the antenna, the plane P containing the electro-acoustic transducer $M_0$. It is of course indicated that the distance separating each electro-acoustic transducer $M_0$, $M_{10}$ of the aerial 1 is taken substantially equal to D=30 cm.

In another mode of use represented in FIG. *7b*, the aerial 1 is placed laterally to the video display monitor on one of the sides of the latter, the aerial then being fixed on the side of the latter by means, for example, of a suction or some other system. In this case, the electro-acoustic transducers $M_9$ and $M_{10}$ can on the contrary be placed symmetrically with respect to the plane of symmetry P of the aerial 1 on two generator lines $G_{10}$, $G_9$ of the convex surface S. Moreover, an electro-acoustic transducer $M_{11}$ belonging to the first sub-antenna, band 1 FIG. *6a*, can be placed at the top of the video display monitor, mid-way between the aerial 1 and the electro-acoustic transducers $M_9$, $M_{10}$ so as to improve the global performance of the antenna.

It is of course understood that in the case of the use according to FIG. *7b*, the directivity diagram of the acoustic antenna thus constituted approximates that of the acoustic antenna such as used in FIG. *7a* with a 90° rotation.

The acoustic antenna which is the subject of the present invention is particularly advantageous insofar as it allows selective sound capture which favours the user while greatly lessening the impairment related to ambient noise and to the room effect. As compared with a single microphone, the current conventional solution, the gain in spatial selectivity is sizeable as is the reduction in the noise internal to the sensor.

Furthermore, the bulkiness constraints of the aerial 1 are not excessive as compared with the solution consisting in using a single microphone.

Furthermore, the analogue digital conversion and the digital processing can be easily integrated into an echo control and coding system.

Finally, the design of the acoustic antenna, which is the subject of the present invention, means that the mechanical mounting is straightforward and industrialization presents no problem.

Given the improvements afforded by the acoustic antenna, which is the subject of the present invention, better listening comfort is afforded to the distant listener whilst, additionally, an improvement in the performance of automatic speech recognition systems is obtained.

We claim:

1. A system for selective sound capture for reverberant and noisy environments, said system including a plurality of electro-acoustic transducers for receiving in-phase useful sound signals arising from a particular useful speaking area, said useful sound signals being summed in phase and the sound signals originating from areas other than said useful area being summed out of phase in order to select the sound signals arising from said useful speaking area, wherein said electro-acoustic transducers are of substantially unidirectional type, said system including, in combination:

an aerial formed by an aerial member having a concave cylindrical surface, said cylindrical surface having concavity oriented towards the useful speaking area, said plurality of electro-acoustic transducers being distributed over and in the vicinity of said cylindrical surface, each electro-acoustic transducer being oriented towards said useful speaking area and delivering an analog sound signal, the unit of the aerial and said electro-acoustic transducers forming an acoustic antenna, said electro-acoustic transducers being distributed as first and second groups, said electro-acoustic transducers of the first group being aligned in an odd number on a line of a curvilinear surface parallel to a directrix line of said aerial member and disposed symmetrically with respect to a plane of symmetry containing a generatorix line of said cylindrical surface and a central electro-acoustic transducer, said electro-acoustic transducers of the second group being distributed over at least one further directrix line of the concave cylindrical surface, different from the directrix line with which the first group is aligned, means for providing partial summation of a plurality of analog sound signals produced by each of said electro-acoustic transducers, according to a specified arrangement, thus allowing formation from said electro-acoustic transducers of a plurality of elementary acoustic antennas each producing a resultant elementary analog sound signal, and means for filtering and summing said resultant elementary analog sound signals so as to produce a resultant analog sound signal representative of the sound signal arising from said useful speaking area.

2. The system for selective sound capture of claim 1, in which said electro-acoustic transducers of the second group are distributed symmetrically with respect to said plane of symmetry.

3. The system for selective sound capture of claim 1, wherein each elementary acoustic antenna further includes filtering means comprising one of a low-pass, band-pass or high-pass frequency filter, the frequency bands transmitted by each filter associated with an elementary acoustic antenna being offset so as to cover a resultant pass band covering frequencies lying between 25 Hz and 7500 Hz.

4. The system for selective sound capture of claim 1, wherein said member with said cylindrical surface is formed by a plastic framework of substantially rectangular shape, said plastic framework including spacers and opposing teeth formed in the plane of said framework, two of said opposing teeth forming a housing for receiving an electro-acoustic transducer, and said framework being shaped in such a way as to form said member with said cylindrical surface.

5. The system of claim 1 wherein said acoustic antenna further includes an electromagnetic shield ensuring immunity of said electro-acoustic transducers to electromagnetic perturbations or disturbances.

6. The system of claim 4, wherein said acoustic antenna further includes an electromagnetic shield ensuring immunity of said electro-acoustic transducers to electromagnetic perturbations or disturbances.

7. The system of claim 6, wherein said electromagnetic shield is formed by a metal grid covering the concave part and the convex part of said member with said cylindrical surface, and the electro-acoustic transducers, said metal grid being electrically connected to the electric reference potential of the electro-acoustic transducers.

8. The system for selective sound capture of claim 1, wherein said transducers of the second group are placed on a mechanical structure independent of said cylindrical surface.

9. The system for selective sound capture of claim 1, said system being associated with a multimedia workstation including a video display monitor, the aerial and the electro-acoustic transducers of the first group being disposed in the vicinity of one side of the video display monitor of the workstation, and the transducers of the second group being placed on at least one director line of the concave cylindrical surface.

* * * * *